United States Patent [19]

Lauritsen et al.

[11] 4,175,223

[45] Nov. 20, 1979

[54] POSITION RESPONSIVE SWITCH

[75] Inventors: Richard L. Lauritsen, Hoffman Estates; Richard S. Philbrick, Chicago, both of Ill.

[73] Assignee: The Singer Company, New York, N.Y.

[21] Appl. No.: 950,137

[22] Filed: Oct. 10, 1978

[51] Int. Cl.[2] ..... H01H 1/36; H01H 15/06

[52] U.S. Cl. ..... 200/159 R; 200/16 C; 200/61.88

[58] Field of Search ..... 200/16 C, 61.88, 67 AA, 200/153 L, 153 LA, 153 LB, 159 R, 297; 123/177 K

[56] References Cited

U.S. PATENT DOCUMENTS

| | | | |
|---|---|---|---|
| 3,187,119 | 6/1965 | Dyksterhouse | 200/16 C |
| 3,423,549 | 1/1969 | Sondej | 200/61.88 |
| 3,461,256 | 8/1969 | Ferryman, Jr. | 200/61.88 |
| 3,940,580 | 2/1976 | Williams et al. | 200/61.88 X |
| 4,079,220 | 3/1978 | Wagner et al. | 200/159 R |

FOREIGN PATENT DOCUMENTS

| | | | |
|---|---|---|---|
| 2557228 | 7/1976 | Fed. Rep. of Germany | 200/159 R |
| 2283028 | 3/1976 | France | 200/277 |
| 763245 | 12/1956 | United Kingdom | 200/277 |

*Primary Examiner*—Stephen Marcus

[57] ABSTRACT

The plastic non-conducting housing is provided with two pairs of terminals the inner ends of which serve as busses and fit in grooves in the interior, each pair being separated by an integral rib which is slightly higher than the busses so the associated spring loaded roller-like shorting bar mounted in the axially moveable carrier is held out of contact with the busses. The molded housing is cored along the length of the rib where switching is desired. Therefore, where the housing is cored there is no rib to prevent the shorting bar from completing the circuit between the busses. When the shorting bar engages the busses the friction between the loading spring and the knurled central section of the roller is greater than the friction between the roller and the busses so the roller slides on the busses to obtain "wipe". When the roller engages the rib the friction between the roller and rib is greater than between the roller and spring so the roller rolls and will present a new surface to the busses on the next operation. The carrier is spring loaded to project out of the housing and is moved inwardly in response to the position of an external mechanism.

6 Claims, 3 Drawing Figures

POSITION RESPONSIVE SWITCH

BACKGROUND OF THE INVENTION

In automobiles having automatic transmissions it is desirable if not necessary to prevent starting the engine unless the transmission is in neutral or park position. This invention relates to a switch which is responsive to the position of a transmission part to enable (close) the starting circuit only when the lever is in park or neutral as well as closing the back up light circuit when the transmission is in reverse.

The most relevant prior art is a switch made by Frank Kirsten KG of Germany. The detailed description of the present invention will point up the differences over that switch but at this point it may be stated that both designs require a cam surface controlling engagement of a shorting bar with spaced terminals (busses). In the Kirsten design the cam is a separate insert in a plastic body. The present design eliminates the insert and provides a cam by simply removing the cam surface where indicated by coring the molded plastic body. This reduces the number of parts and increases accuracy of the switching. The shorting bar is provided with a knurled surface which results in a rolling action of the shorting bar when the bar is out of engagement with the busses and results in sliding the bar on the busses.

SUMMARY OF THE INVENTION

The principal object of this invention is to provide a position responsive switch similar to the Kirsten switch but at lower cost and having superior performance.

Another object is to provide an integral longitudinal cam on the interior of a plastic body. The inner surface of the cam holds the shorting bar out of contact with busses on each side of the cam. At those points along the cam where it is desired to have the shorting bar engage the busses the plastic body molding is cored to remove the rib to permit the shorting bar to engage the terminals. The shorting bar is cylindrical and the central portion of the bar is knurled and engaged by a spring which urges the bar into engagement with the busses. Since the friction between the bar and the busses is less than the friction between the biasing spring and the shorting bar the shorting bar will slide (wipe) on the busses. When the bar is on the cam the friction between the bar and cam is greater than the friction between the biasing spring and the bar. Therefore, the bar will roll along the rib and will present a new surface to the busses when next it engages the busses. The Kirsten switch does not provide the slide and roll action and uses separate cam inserts in the body with extra cost and some loss of switching accuracy.

DETAILED DESCRIPTION OF THE DRAWINGS

Figure 2:
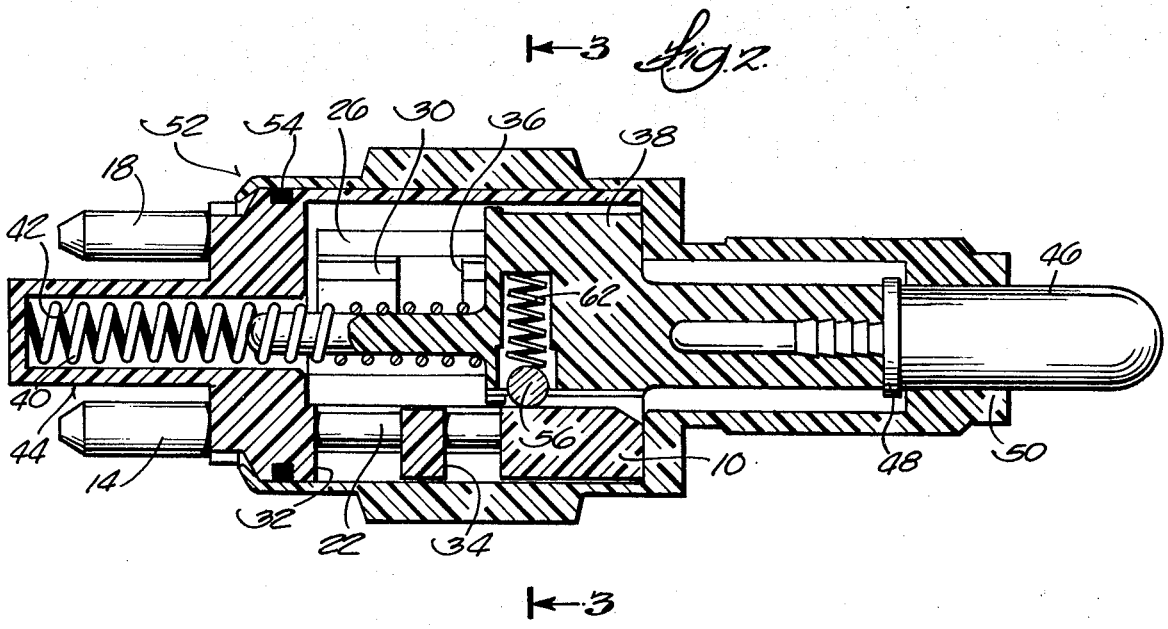
FIG. 2 is a vertical section taken in line 2—2 in FIG. 1.

The switch assembly is provided with a molded plastic housing 10 in which 4 terminals 12, 14, 16, 18 are mounted with the reduced ends 20, 22, 24, 26 projecting into the interior of the body 10 and received in the internal grooves molded into the body. The inner reduced ends 20, 22, 24, 26 serve as paired busses. Thus, busses 20, 22 constitute one pair while busses 24 and 26 constitute the other pair. Each pair is separated by a longitudinal rib molded in the interior of the body which serves as a cam. Pair 20, 22 is separated by rib 28 and pair 24, 26 is separated by rib 30. The switch body 10 is cored during the molding operation to provide holes through the body intercepting the ribs or cams. Thus rib 28 is interrupted by cored holes 32, 34 and rib 30 is interrupted by the cored hole 36.

Figure 1:
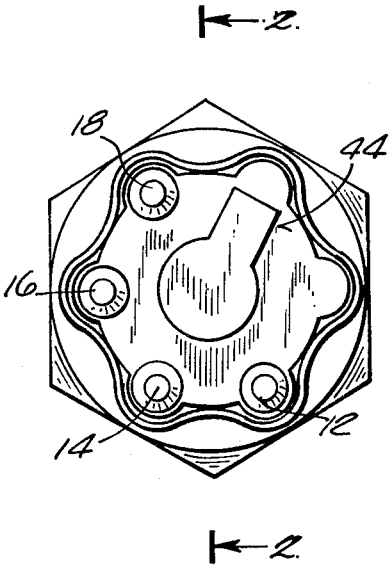
FIG. 1 is an end view of the switch taken from the left in FIG. 2.
Figure 3:
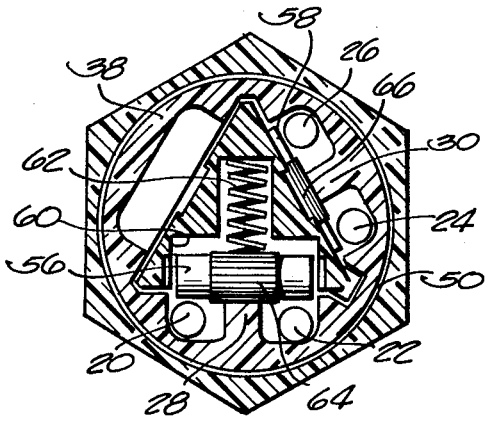
FIG. 3 is a cross-section taken on line 3—3 in FIG. 2.

A reciprocable spring loaded carrier and plunger assembly is mounted in the switch body. Carrier 38 is biased to the right (FIG. 2) by spring 40 compressed between the carrier and the end of the cavity 42, the exterior of which is in the form of a key 44 (FIG. 1). Plunger 46 is press-fit in the right hand portion of the carrier and has a slightly enlarged portion 48 having a diameter greater than the hole in the right hand portion of the metal case 50 through which the plunger projects. The left hand portion of the case 50 is crimped over the plastic body at 52 to capture the plunger and provide a bearing for the plunger. The space between the metal case and the plastic body is sealed by "O" ring 54. This arrangement prevents the plunger from separating from the carrier and falling into the transmission.

The carrier carries two cylindrical shorting bars 56, 58. Bar 56 is received in pocket 60 in the carrier and is biased outwardly by spring 62 compressed between the end of the generally diametrical cavity in the carrier and the knurled central portion 64 of the shorting bar 56. The other shorting bar 58 is similarly mounted in the carrier and is also provided with a central knurled portion 66.

The shorting bar 56 will ride on the inner surface of rib 28 where the rib is not interrupted by a cored hole. The rib is slightly higher than the plane of the inner surfaces of the adjacent busses 20, 22. Therefore, when the shorting bar is on the rib, the bar cannot contact the adjacent busses 20, 22. However, when the roller drops off the rib, i.e., comes to a position in its movement along the length of the molded body where the cam is interrupted by a cored hole, the smooth ends of the roller can now drop onto the busses 20, 22 and complete the circuit between the busses. The height of the cam is preferably lower to the right of the end of the busses so as to allow for errosion of the busses throughout their service life without having a step in the cam at that point, possibly preventing full stroke of the plunger to the right after the buss has eroded.

The rib or cam 28 is interrupted by holes 32, 34 which represent the "park" and "neutral" positions of the transmission part sensed by plunger 46. Busses 20, 22 are wired in series with the ignition circuit and this results in the ignition being able to be completed only when the transmission is in park or neutral. The other rib 30 is interrupted by hole 36 representing the position when the transmission is in reverse and the adjacent busses 24, 26 are in the backup light circuit so that the backup lights will go on automatically when the transmission is in reverse.

As indicated above, the Kirsten switch is similar to the construction described except that the cams are separate parts inserted into the plastic body. This not only results in higher cost but is less accurate than coring the body mold to provide the holes and thus the cam contour.

The provision of the central knurled portion on each of the cylindrical shorting bars has a significant advantage. It will be appreciated that there is friction between the shorting bar biasing spring and the knurled portion. That friction is appreciably greater than the friction between the smooth ends of the shorting bar and the busses. Therefore, when the busses are contacted by the shorting bar the friction between the biasing spring and the knurled section will prevent the shorting bar from rotating with the result that the bar will slide along the busses and will achieve desirable contact wipe which increases the service life of a switch. However, when the knurled section is riding on the cam, the friction between the knurled section and the relatively soft plastic surface is greater than the friction between the hard surfaces of biasing spring and the knurled portion. This will result in forcing the cylindrical bar to roll along the cam. When the shorting bar reengages the busses, a new surface will be presented to the busses so as to distribute the wear on the bar uniformly about its surface.

A further cost reduction can be visualized by replacing the cylindrical shorting bar and the associated biasing spring with a one-piece wiper-spring, stamped and formed from sheet metal and fixed in the carrier so as to be preloaded against the cam. This would retain the desirable feature of wiping the shorting bar along the buss.

We claim:

1. In a switching device having a hollow molded plastic body, a carrier mounted for axial movement in the body, spaced conductors fixed in the body parallel to each other and to the movement axis of the carrier, the improvement comprising a rib molded integrally with the body between the conductors, a shorting bar carried by said carrier for axial movement therewith and for movement transverse the axis into engagement with said conductors or with said rib, said rib having such height that it projects above a plane through the inner surface of both conductors and therefore prevents engagement of the shorting bar with the conductors, a cored hole through the body and the rib at a predetermined axial location so movement of the shorting bar into engagement with the conductors is unrestrained at said location.

2. The device of claim 1 including a second cored hole through said body and rib axially spaced from the first hole whereby the shorting bar can engage the conductors at two positions along the travel path of the carrier.

3. The device of claim 2 in which the shorting bar is cylindrical and its axis is perpendicular the path of travel of the carrier, a spring urging the shorting bar into engagement with either the rib or conductors.

4. The device of claim 3 in which the central portion of the cylindrical shorting bar has a roughened surface which engages the rib and the ends of the bar are smooth and respectively engage the conductors, the friction between the central portion of the bar and rib being greater than the friction between the central portion of the bar and said spring which is greater than the friction between said ends and the conductors.

5. A switch having a hollow generally cylindrical molded plastic body, a carrier mounted in the body for reciprocable movement along the axis of the body and having an actuating plunger projecting from the body, spaced parallel conductors mounted on the inside of the body parallel to said axis, a shorting bar carried by said carrier for axial movement therewith and for radial movement relative to the carrier, characterized by a rib molded integrally with the body between said conductors and of such height that it prevents the shorting bar from contacting said conductors, and a cored hole through said body and said rib so radial movement of the shorting bar is not restrained by the rib and the shorting bar can contact the conductors.

6. A switch according to claim 5 in which the shorting bar is cylindrical and is received in a pocket in the carrier, a spring biasing the bar towards the rib and conductors, the central portion of the bar being knurled and engaged by the spring and being engageable with the rib, the ends of the bar being smooth, the friction between the spring and the knurled portion being less than the friction between said portion and the rib but greater than the friction between the smooth ends of the bar and the conductors.

* * * * *